US005433289A

United States Patent [19]

O'Rourke

[11] Patent Number: 5,433,289

[45] Date of Patent: Jul. 18, 1995

[54] WORKERS' MULTI-FUNCTIONAL HARNESS

[75] Inventor: Michael J. O'Rourke, Beaumont, Canada

[73] Assignee: Surety Manufacturing & Testing Ltd., Edmonton-Alberta, Canada

[21] Appl. No.: 280,466

[22] Filed: Jul. 26, 1994

[51] Int. Cl.[6] ..... A62B 35/00

[52] U.S. Cl. ..... 182/3; 182/6

[58] Field of Search ..... 182/3-7; 244/151 R

[56] References Cited

U.S. PATENT DOCUMENTS 4,991,689 2/1991 Cole ..... 182/3
5,203,829 4/1993 Fisk ..... 182/3

FOREIGN PATENT DOCUMENTS 1246506 12/1988 Canada .
2028090 4/1992 Canada .

*Primary Examiner*—Alvin C. Chin-Shue
*Attorney, Agent, or Firm*—Jacobson, Price, Holman & Stern

[57] ABSTRACT

The invention comprises a multi-functional worker's harness of the type comprising interacting shoulder and sub-pelvic harnesses. The shoulder strap comprises a pair of interacting strap sections, which are not attached to each other. Each strap section has a pair of ends secured to a releasable buckle and each section, when in position on a wearer, extends from one end at an opposite side near the wearer's waist at the front, over the opposite shoulder of the wearer, down the wearer's back and around the wearer's side to the other end of that section at a point on the same side as it is positioned on the front. The sections, where they cross over each other at each of the front and back, pass through and are held in overlapping fashion by a friction buckle. The sub-pelvic strap comprises a pair of strap sections, each having a pair of ends secured to releasable buckle to cooperate with a corresponding buckle of the shoulder strap sections. Each of the strap sections of the sub-pelvic strap are of a length to permit wrapping about a different one of a worker's legs and its ends to be buckled to corresponding end buckles of a corresponding one of the shoulder strap sections. A further strap section is secured to and extends between intermediate portions of the sub-pelvic sections and is intended to rest behind the wearer's seat when in position. A corresponding pair of the buckles are provided with adjustment means to permit symmetrical adjustment of the strap section lengths when in position on the wearer.

5 Claims, 2 Drawing Sheets

WORKERS' MULTI-FUNCTIONAL HARNESS

BACKGROUND OF THE INVENTION

The present invention relates to a multi-fictional worker's safety harness, and more particularly to a harness which will function, as required, for fall protection, ladder climbing, controlled descent and worker positioning.

Workers' safety harnesses have traditionally been constructed for a single one of these functions. For instance for work positioning, conventionally a worker's belt has been provided with rings to either side, so that positioning line can extend from one side of the worker, about an object such as a telephone pole, to the other side. By loosening the tension on the line, the worker can move to a different vertical location on the pole, and then become secured in the new location by increasing the tension again on the line.

Another problem with conventional harnesses has been that they often only fit comfortably on the male anatomy. Such harnesses have for instance featured parallel straps extending across the wearer's chest, a most uncomfortable construction for most females.

Other safety harnesses, for example, are designed for ladder climbing, have featured a D-ring secured centrally in a belt worn by the worker. If the worker fell, he or she would be restrained by a tether secured to the D-ring at the waist, thus putting tremendous pressure on the wearer's spine and neck.

A safety harness having adjustable front D-rings has been described and illustrated in Fisk et al U.S. Pat. No. 5,203,829 issued Apr. 20, 1993. That harness features a pair of interacting straps, one being a shoulder strap and the other being a waist and seat strap. The two straps are slidably connected through a slide ring assembly. Adjustment of the harness, to snugly fit a particular wearer is done asymmetrically from an adjustment buckle on the waist strap, the adjustment of which also affects the positioning of a tether ring where the shoulder strap and waist strap meet on the front, and an adjustment buckle on a portion of the shoulder strap. The shoulder strap is made of two sections which cross over at the front and back, but which are secured by way of stitching, to a leather backpad, at the back.

Other patents of general background interest are Canadian Patent No, 2,028,090 of Olsson, teaching a type of shoulder strap having resiliently yielding springs or the like and Canadian Patent No. 1,246,506 of Eckman teaching varies types of clothing in which safety straps are inserted.

It is an object of the present invention to provide a safety harness which is simple in design and which can be adjusted by a wearer easily and without confusion. It is a further object of the invention to provide such a safety harness which is multi-functional and is readily adjustable to a variety of body shapes and sizes for males or females.

It is a further object of the present invention, to provide, in such a safety harness, a variety of connection points which allow the harness to be used for any typical work task that requires a person to be suspended or to arrest an accidental fall.

SUMMARY OF THE INVENTION

In accordance with the present invention there is provided a multi-functional worker's harness of the type comprising interacting shoulder and sub-pelvic harnesses. The shoulder strap comprises a pair of interacting strap sections, which are not attached to each other. Each strap section has a pair of ends secured to a releasable buckle means. Each section, when in position on a wearer, extends from one end at an opposite side near the wearer's waist at the front, over the opposite shoulder of the wearer down the wearer's back and around the wearer's side to the other end of that section at a point on the same side as it is positioned on the front. The sections, where they cross over each other at each of the front and back, pass through and are held in overlapping fashion by a friction buckle. The sub-pelvic strap comprises a pair of strap sections, each having a pair of ends secured to releasable buckle means to cooperate with corresponding buckle means of the shoulder strap sections. Each of the strap sections of the sub-pelvic strap are of a length to permit wrapping about a different one of a worker's legs and its ends to be buckled to corresponding end buckles of a corresponding one of the shoulder strap sections. A further strap section is secured to and extends between intermediate portions of the sub-pelvic sections and is intended to rest behind the wearer's seat when in position. A corresponding pair of the buckle means are provided with adjustment means to permit symmetrical adjustment of the strap section lengths when in position on the wearer.

It is preferred that the sub-pelvic strap and the shoulder strap be interconnected by strap loop means located on each side of the wearer when the harness is in position on the wearer. Line or tether connection points, when the harness is worn, are preferably located at either side of the wearer's waist in the strap loop means. As well, a tether attachment ring is preferably secured to each of the shoulder straps and the corresponding friction buckle where they cross over at each of the front and back.

The safety harness having such tether and line attachment points will suspend an unconscious person in a relatively upright position. Suspension from the harness during a fall applies the force of the fall to the pelvic area rather than to the wearer's spine or neck. The design of the strap is both functional and permits a symmetrical adjustment which is easy for a worker to carry out. The harness according to the present invention is readily adjustable to a variety of body shapes and sizes. Its construction is suitable for female anatomies.

BRIEF DESCRIPTION OF THE DRAWINGS

These and other objects and advantages of the invention will become apparent upon reading the following detailed description and upon referring to the drawings in which.

Figure 1:
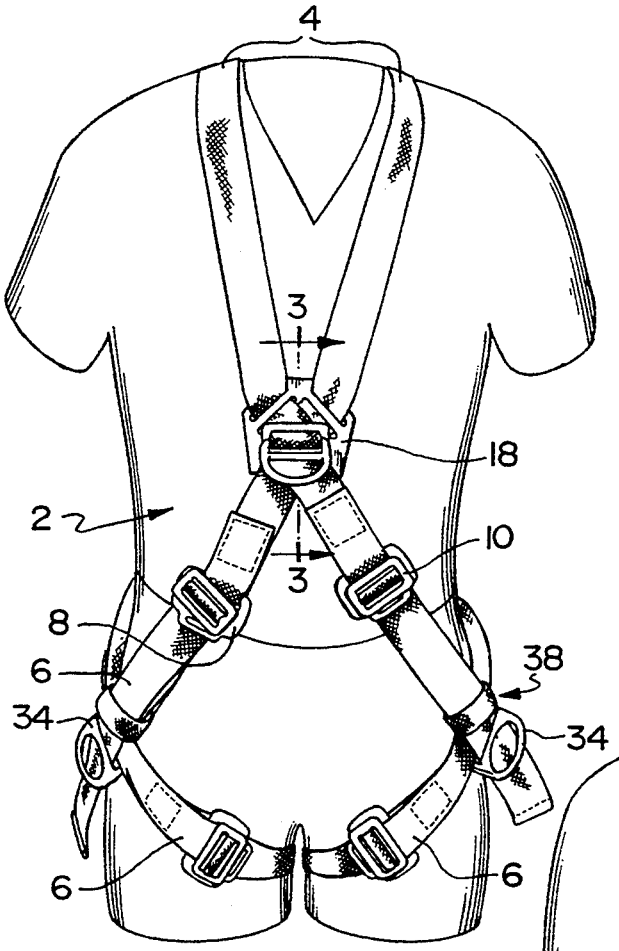
FIG. 1 is a perspective view of a harness according to the present invention, worn on a worker, when viewed from the front.

While the invention will be described in conjunction with an illustrated embodiment, it will be understood that it is not intended to limit the invention to such an embodiment. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the drawings, similar features have been given similar reference numerals.

Figure 2:
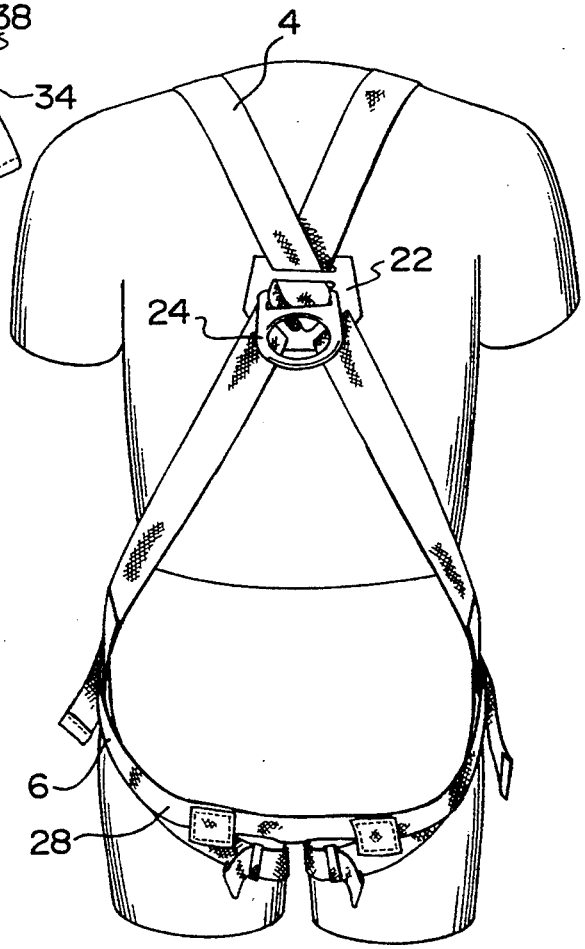
FIG. 2 is a perspective view of a harness according to the present invention, worn on a worker, when viewed from the back.
Figure 3:
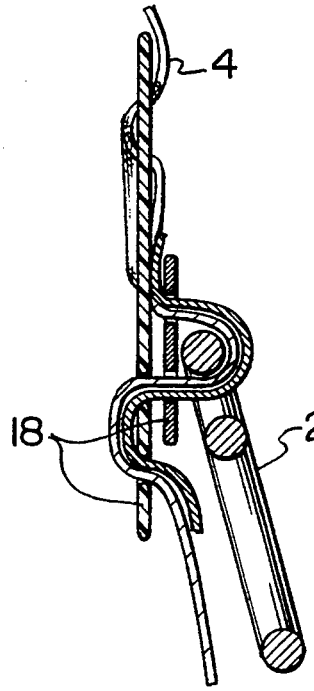
FIG. 3 is a section view taken along line III—III of FIG. 1.

Turning to the drawings, FIGS 1 and 2 illustrate a preferred embodiment of harness 2 in accordance with the present invention. Harness 2 comprises a pair of shoulder strap sections 4, the ends of which are releasably securable to corresponding ends of a pair of sub-pelvic strap sections 6 as illustrated. A female D-ring buckle 8 is secured to each end of shoulder strap sections 4, and a cooperating male D-ring buckle 10 is secured the corresponding end of each sub-pelvic strap 6 to permit reliable and secure connection of corresponding strap section ends, when the straps are under tension, but easy release when they are not under tension. As can be seen in FIG. 1, shoulder strap sections 4 cross over and are slidably engaged, at their cross over point, by a friction buckle 18. Friction buckle 18 has associated with it a D-ring 20 as illustrated more particularly in FIG. 3. D-ring 20 and friction buckle 18 may be adjusted for upwardly or downwardly positioning relative to the front portions of shoulder straps 4, so that a tether line (not shown), one end of which is secured to D-ring 20, is both comfortable and safe in operation.

As can be seen in FIG. 2, shoulder strap sections 4 also cross over at the back, with a dorsal friction buckle 22 and associated D-ring 24 being provided, in a manner and operation similar to that of frontal friction buckle 18 and D-ring 20.

Male D-ring buckles 8 of sub-pelvic strap sections 6 are provided, at their ends which connect with shoulder strap sections 4 at the front, are preferably with adjustment buckles, so that the length and positioning of shoulder strap sections 4 and sub-pelvic strap sections 6 may be easily and appropriately adjusted in a symmetrical fashion.

As well to intermediate portions of sub-pelvic strap sections 6 is secured an intermediate seat strap 28, intended to extend between those sections and rest behind the wearer's seat when in position.

Figure 4:
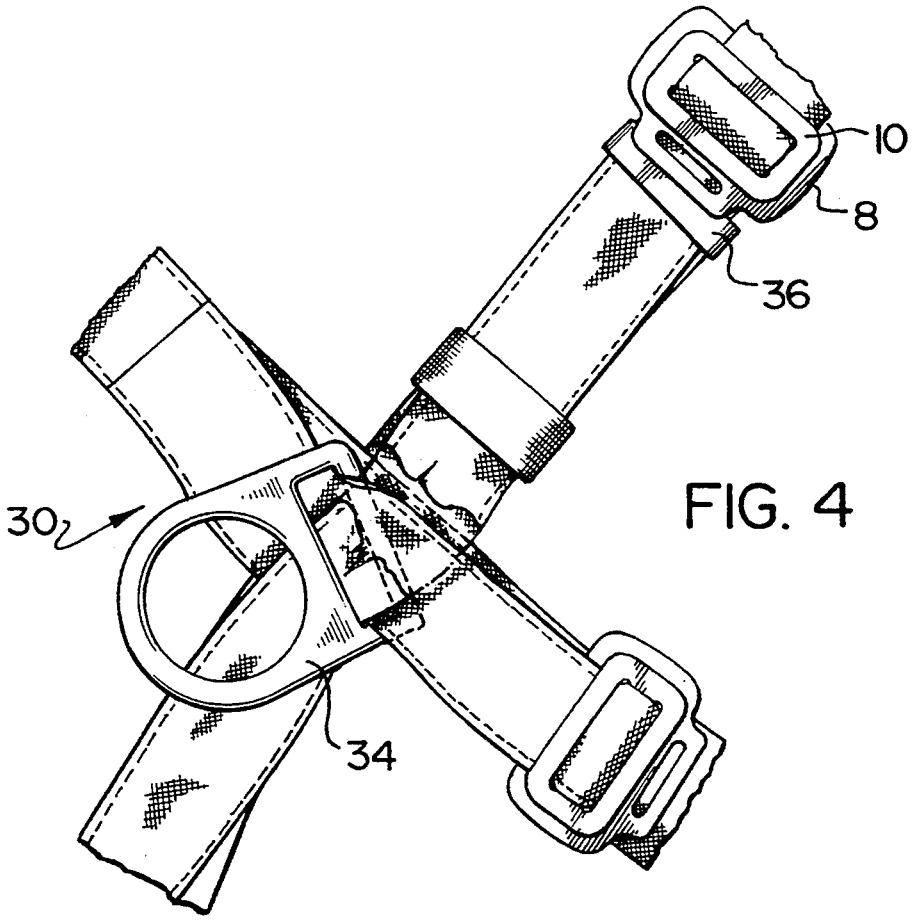
FIG. 4 is an enlarged partial view of interconnected strap loop sections of the harness in accordance with the present invention.

Another feature of the safety harness according to the present invention are the intersecting strap loops 30 which are formed in cooperating shoulder and sub-pelvic strap sections, on each side of harness 2, which intersecting loops secure these corresponding sections of the straps loosely together. As well, intersecting loops 30 provide a location and means for anchoring side positioning D-rings 32 as illustrated (FIG. 4) so these D-rings are simultaneously attached to both shoulder and sub-pelvic strap sections. These intersecting loops 30 and side D-rings, when the harness is in position on a wearer, are intended to be located about the wearer's waist to either side.

More generally, the harness 2 in accordance with the present invention, with the construction as thus defined, includes two continuous shoulder strap sections 4 which cross each other at frontal and dorsal friction buckles 18 and 22 respectively. All shoulder strap sections 4 terminate in female D-ring buckles 8. The positions (heights) of the frontal and dorsal friction buckles 18 and 22 respectively are adjusted by sliding both strap sections 4 simultaneously through the corresponding friction buckle, rather than by adjusting the length of either strap (as in the case of the previously described Fisk et al device). It is preferred that the frontal friction buckle 18 be positioned between the sternum and the umbilicus and that the dorsal friction buckle 22 be positioned between the shoulder blades. Although the frontal friction buckle 22 is adjustable, the unique design of friction buckle 18 and D-ring 20 will not allow significant slippage during shock loading of this part of the harness.

The sub-pelvic strap sections 6 and intermediate seat strap 28 cradle the pelvis and wrap around the legs to safely distribute the force a person experiences during a sudden shock load. Sub-pelvic strap sections 6 wrap under the buttocks of the wearer, where they are contained by portions of the shoulder strap sections 4 at the hip and pass through the male half of the adjustment buckle 10 before ending in a sewn termination as illustrated. The sub-pelvic strap sections extend to wrap around upper portions of both legs where they then pass through the male half of adjustment buckles 10 before ending in a sewn termination, again as illustrated.

Harness 2 is donned by placing the shoulder strap sections 4 over the wearer's head. The frontal shoulder strap buckles 8 connect to the sub-pelvic strap sections 6 at adjustment buckles 10 which accommodate height and girth. This adjustment is done equally at each buckle and in full view of the user. The dorsal shoulder strap buckles 8 connect to the leg strap at adjustment buckles 10 which accommodate upper thigh girth. Plastic keepers 36 (FIG. 4) are installed on the webbing adjustment to each buckle 10. When a keeper 36 is moved against the corresponding buckle, security of the positioning of buckle is assured.

The frontal attachment hardware represented by friction buckle 18 and D-ring 20 is designed to provide fall protection on a very short coupled tether or lanyard (not illustrated) or to suspend the user from a rope or structure. The design of the dorsal attachment hardware represented by dorsal friction buckle 22 and D-ring 24 is most suitable for sustaining the impact load of a fall arrest. Both the above attachment points will suspend an unconscious person in a relatively upright position (less than 30° from the vertical). Suspension from the harness 2 of the force of falls is applied to the pelvic area rather than spine or neck. The positioning rings 32 at the waist or hip can be attached to a positioning lanyard (again not illustrated).

Thus it is apparent that there has been provided in accordance with the invention a workers' multi-functional harness that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A multi-functional worker's harness assembly comprising:

interacting shoulder and sub-pelvic harnesses, said shoulder harness including a pair of separate, interacting first and second strap sections, each strap section having a pair of ends secured to one part of a two part releasable buckle and each strap section, when in position on a wearer, extending from one end near the waist at the front, over the opposite shoulder of the wearer, down the wearer's back and around the wearer's side to the other end of each respective strap section at a point on the same side as it is positioned on the front, the strap sections, where they cross over each other at each of the front and back of the wearer passing through and being held in overlapping fashion by a friction buckle, said sub-pelvic harness including first and second strap sections, each having a pair of ends, each end secured to a second part of said two part releasable buckle, each of said strap sections of said sub-pelvic harness being of a length to permit at least partial wrapping about a different one of a worker's legs and ends of said strap sections of said sub-pelvic harness being buckled to a corresponding buckle part of a corresponding one of said shoulder harness strap sections so that said two ends of said first shoulder strap section are connectable to said two ends of said first sub-pelvic strap section and said two ends of said second shoulder strap section are connectable to said two ends of said second sub-pelvic strap section to form four releasable buckle connections, two of said four releasable buckle connections securing a worker's legs in the harness assembly, a further strap section secured to and extending between intermediate portions of said sub-pelvic harness strap sections for resting behind the wearer's seat when in position, and the other two of said four releasable buckle connections, which are at the front when in position on the wearer, being provided with adjustment means allowing symmetrical adjustment of said strap sections of said sub-pelvic harness when in position on the wearer for one of elongating and shortening the harness assembly.

2. A harness assembly according to claim 1 wherein the sub-pelvic strap and the shoulder strap are interconnected by strap loop means located on each side of the wearer when the harness is in position on the wearer.

3. A harness assembly according to claim 2 further comprising positioning ring means secured to the sub-pelvic strap and the shoulder strap at the loop means at each side.

4. A harness assembly according to claim 2 wherein a tether attachment ring is secured to each of the shoulder straps and the corresponding friction buckle where they cross over each at the front and back.

5. A harness assembly according to claim 3 wherein a tether attachment ring is secured to each of the shoulder straps and the corresponding friction buckle where they cross over each at the front and back.

* * * * *